US007806549B2

(12) United States Patent
Beaulieu

(10) Patent No.: US 7,806,549 B2
(45) Date of Patent: Oct. 5, 2010

(54) ILLUMINATED CABINET SOFFITS AND APRONS

(76) Inventor: Jeffrey S. Beaulieu, 237 Charles St., Farmington, NH (US) 03855

( * ) Notice: Subject to any disclaimer, the term of this patent is extended or adjusted under 35 U.S.C. 154(b) by 180 days.

(21) Appl. No.: 12/007,969

(22) Filed: Jan. 17, 2008

(65) Prior Publication Data

US 2009/0185366 A1 Jul. 23, 2009

(51) Int. Cl.
*F21V 33/00* (2006.01)

(52) U.S. Cl. ..... 362/133; 362/812; 40/575

(58) Field of Classification Search ..... 362/133, 362/134, 217.15, 812; 40/490, 491, 540, 40/564, 575, 576

See application file for complete search history.

(56) References Cited

U.S. PATENT DOCUMENTS

| | | | | |
|---|---|---|---|---|
| 2,145,238 | A | 1/1939 | Falk | |
| 2,708,711 | A | 5/1955 | McGinty et al. | |
| 2,732,484 | A | 1/1956 | Lipscomb | |
| 3,867,626 | A | 2/1975 | Wilson | |
| 4,058,718 | A | 11/1977 | Palka | |
| D251,528 | S | 4/1979 | Pearson | |
| 4,177,506 | A | 12/1979 | Easterling | |
| 4,848,017 | A * | 7/1989 | Bailey et al. | 40/576 |
| 5,292,281 | A | 3/1994 | Butler | |
| 5,426,572 | A | 6/1995 | Weinstock et al. | |
| 5,622,424 | A * | 4/1997 | Brady | 362/812 |
| 6,065,854 | A | 5/2000 | West et al. | |
| 6,161,351 | A | 12/2000 | Simpson | |
| 6,640,474 | B2 * | 11/2003 | Knoerzer et al. | 40/564 |
| 6,814,462 | B1 | 11/2004 | Fiene | |
| 6,964,504 | B2 | 11/2005 | Newbold | |
| 7,156,537 | B1 | 1/2007 | Cohrs | |
| 2007/0121314 | A1 | 5/2007 | Sanborn et al. | |

FOREIGN PATENT DOCUMENTS

| | | |
|---|---|---|
| JP | 4-193215 | 7/1992 |
| JP | 4-341219 | 11/1992 |

OTHER PUBLICATIONS

Website, http://oikos.com/library/airsealing/recessed_lights.html, series of different lighting installations, three sheets printed from the internet on Jul. 23, 2007.

Website, http://www.fineartlamps.com/proddetail.asp?style=703250ST, Bath Bar soffit, one sheet printed from the internet on Jul. 23, 2007.

Website, http://www.fineartlamps.com/hi-res.asp?style=703250ST, enlargement of Bath Bar soffit, two sheets printed from the internet on Jul. 23, 2007.

* cited by examiner

*Primary Examiner*—Y My Quach Lee
(74) *Attorney, Agent, or Firm*—Richard C. Litman

(57) ABSTRACT

The illuminated cabinet soffits and aprons each include at least one pocket formed therein for removably placing a panel capable of transmitting light therethrough. The pockets may be formed by cutting a saw kerf between the two opposite panel faces, by separating the front and rear sheets of the panel with spacers, or by adding spacers to the back of a front sheet and attaching a series of webs to the spacers. The front of each panel includes at least one light passage therein. The light passage may have any regular or irregular geometric shape, or may be in the outline of a caricature, an object or symbol relating to an occupation or hobby, etc. The light passage through the rear of the panel may be any desired shape. Various attachments may be provided for removably attaching the panels to the cabinets for interchanging the panels.

9 Claims, 6 Drawing Sheets

ILLUMINATED CABINET SOFFITS AND APRONS

BACKGROUND OF THE INVENTION

1. Field of the Invention

The present invention relates generally to electrical lighting. More specifically, the present invention relates to illuminated cabinet soffits and aprons for wall-mounted hanging kitchen cabinets and other wall-mounted hanging cabinets commonly installed in the home, shop, and workplace.

2. Description of the Related Art

Wall-mounted hanging cabinets are a nearly universal means of providing storage space for various articles in a number of different environments. Such cabinets can vary greatly in their vertical extent and mounting height, but are generally mounted with their bases about five feet above the floor. Such cabinets are generally about two to two and one-half feet high from bottom to top, which results in a gap of between six inches and one foot in height above the cabinets in the case of the typical eight-foot high ceiling of most structures in the U.S. This above-cabinet open space is often used to store infrequently used articles and for running additional wiring, conduit, pipe, etc. Whatever the actual use to which this above-cabinet gap is put, the result is generally rather unsightly.

As a result many people will cover this above-cabinet gap with a closure panel or soffit of some sort, generally without lighting or any particular decorative aspects. In some cases, the soffit panels may be ornamented or decorated in some manner, but very few have included any lighting. Where lighted soffits have been developed, they generally use a translucent panel with no decorative pattern to serve as room lighting. In any event, such soffit panels are generally permanently installed, with no provision for changing the appearance of the soffit panels without major remodeling effort.

Under-cabinet lighting is also often installed beneath such hanging wall cabinets. Such under-cabinet lighting is used to illuminate the underlying countertops or the like. Often, an apron is attached to the lower edge of the wall-mounted cabinetry to block generally horizontal light emission directly into the eyes of a person in the area of the cabinetry. As such, there is generally no provision for light output through the apron. These aprons at best generally have only rudimentary ornamental appearance to match the adjacent cabinetry; seldom is any additional ornamentation provided. As in the case of conventional soffit installations, there is generally no provision for modifying or changing the appearance of such aprons without a fair amount of remodeling work.

The present inventor is aware of various examples of lighting installed with cabinetry. One such example is found in Japanese Patent No. 4-193,215 published on Jul. 13, 1992, which describes (according to the drawings and English abstract) an under-cabinet lighting system actuated by a photocell. A light barrier is installed surrounding the under-cabinet light, depending from the bottom of the overlying cabinet. The photocell is installed exterior to the light and light barrier in order to detect variations in the lighting pattern without being affected by the under-cabinet lighting.

Japanese Patent No. 4-341,219 published on Nov. 27, 1992, describes (according to the drawings and English abstract) a single lighting unit for a divided produce case or the like. The single light is installed in a partition between the two sections of the case, thereby projecting light into both sections.

None of the above inventions and patents, taken either singly or in combination, is seen to describe the instant invention as claimed. Thus, illuminated cabinet soffits and aprons solving the aforementioned problems are desired.

SUMMARY OF THE INVENTION

The illuminated cabinet soffits and aprons, collectively addressed as illuminated cabinet panels, are installed to extend between the upper edge of hanging wall-mounted cabinet and the overlying ceiling structure and to depend from the lower periphery of such wall-mounted cabinets. Each of the soffit and apron panels includes at least one light passage therethrough, with a corresponding pocket for holding a removable light transmitting pane therein. The pocket may be formed by cutting a saw kerf between and parallel to the two faces of the panel, by spacing apart the front and rear sheets of the panel with a series of ribs or spacers, or by applying a series of such ribs to the back surface of the panel and applying wider webs to those ribs. The upper edge of the pocket is always open, permitting access to the translucent pane therein for removal thereof and interchange with another pane for changing the color, etc.

Preferably, each soffit or apron panel has a plurality of light passages therethrough, with a pocket generally centered therebehind for holding a translucent pane therein. The light passages on at least the front face of the panel may be in any decorative or other form or shape as desired, e.g., various regular or irregular geometric shapes, caricatures, outlines of various articles such as automobiles, airplanes, locomotives, etc., or shapes of various articles relating to an occupation or hobby, e.g., musical instruments, etc. The light opening formed in the rear face of the panel may be an easily formed regular shape, e.g., a circular opening, etc.

In addition to providing for the interchange of different translucent panels in the pockets of the panels, the panels themselves may be removably installed within the front of the soffit space or below the edges of the cabinets if so desired. Such a removable installation permits the panels to be readily interchanged to provide light openings having different themes, if so desired. The soffit and apron panels may be provided in prefabricated lengths, with joining brackets provided for assembling two or more such soffit or apron panels end-to-end to provide a longer run, if so desired.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention relates to illuminated cabinet soffits and aprons (collectively described as "panels") for installation with cabinets and similar environments. Each of the soffits and aprons includes at least one pocket therein for the removable installation of a pane capable of transmitting light therethrough, with each of the panels preferably being elongate and including a series of such pockets therein. The panes may be exchanged to provide decorative lighting of different colors or producing different lighting effects.

Figure 1:
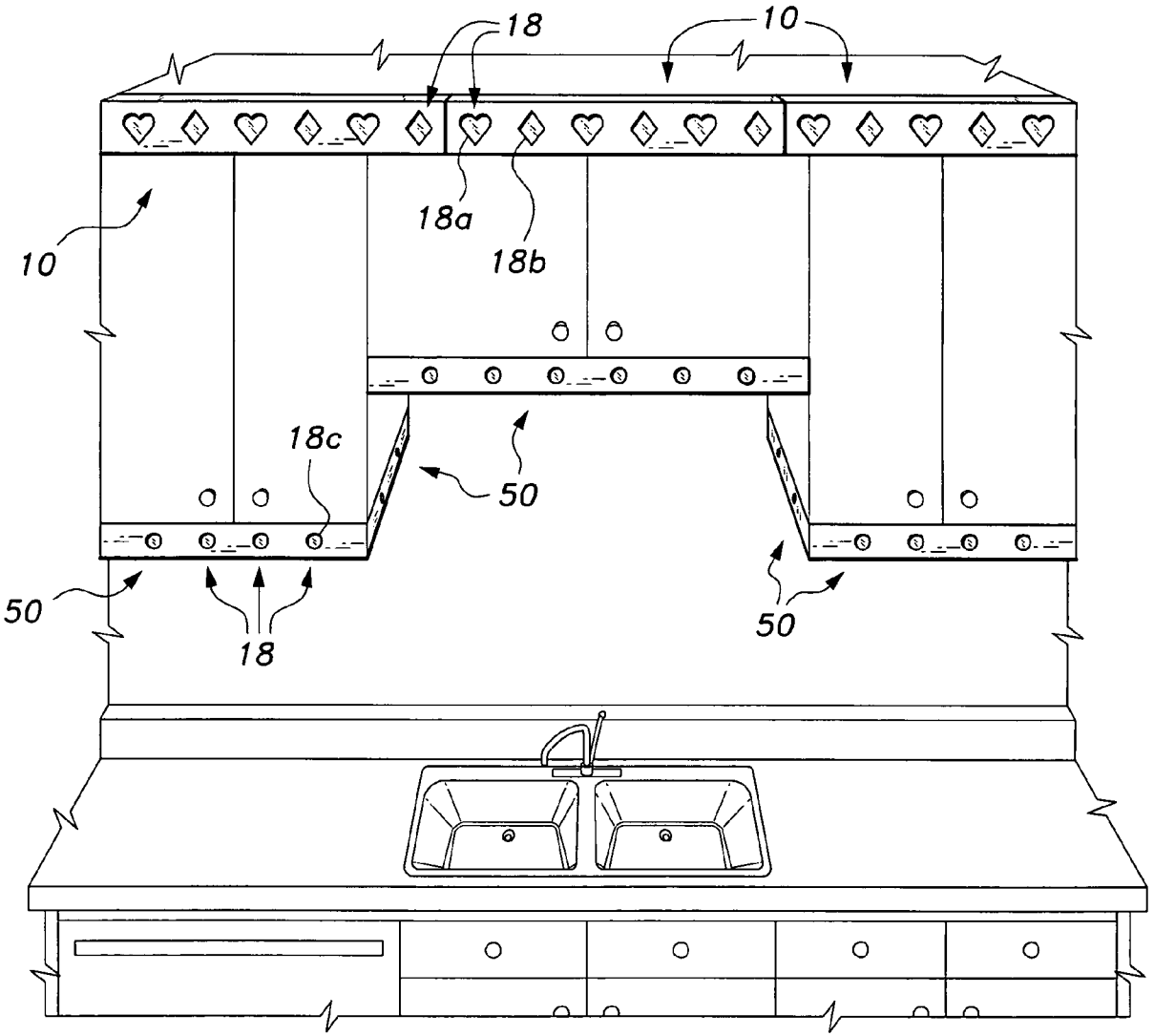
FIG. 1 is an environmental, perspective view of kitchen cabinets incorporating the illuminated cabinet soffits and aprons according to the present invention, illustrating an exemplary installation.
Figure 2:
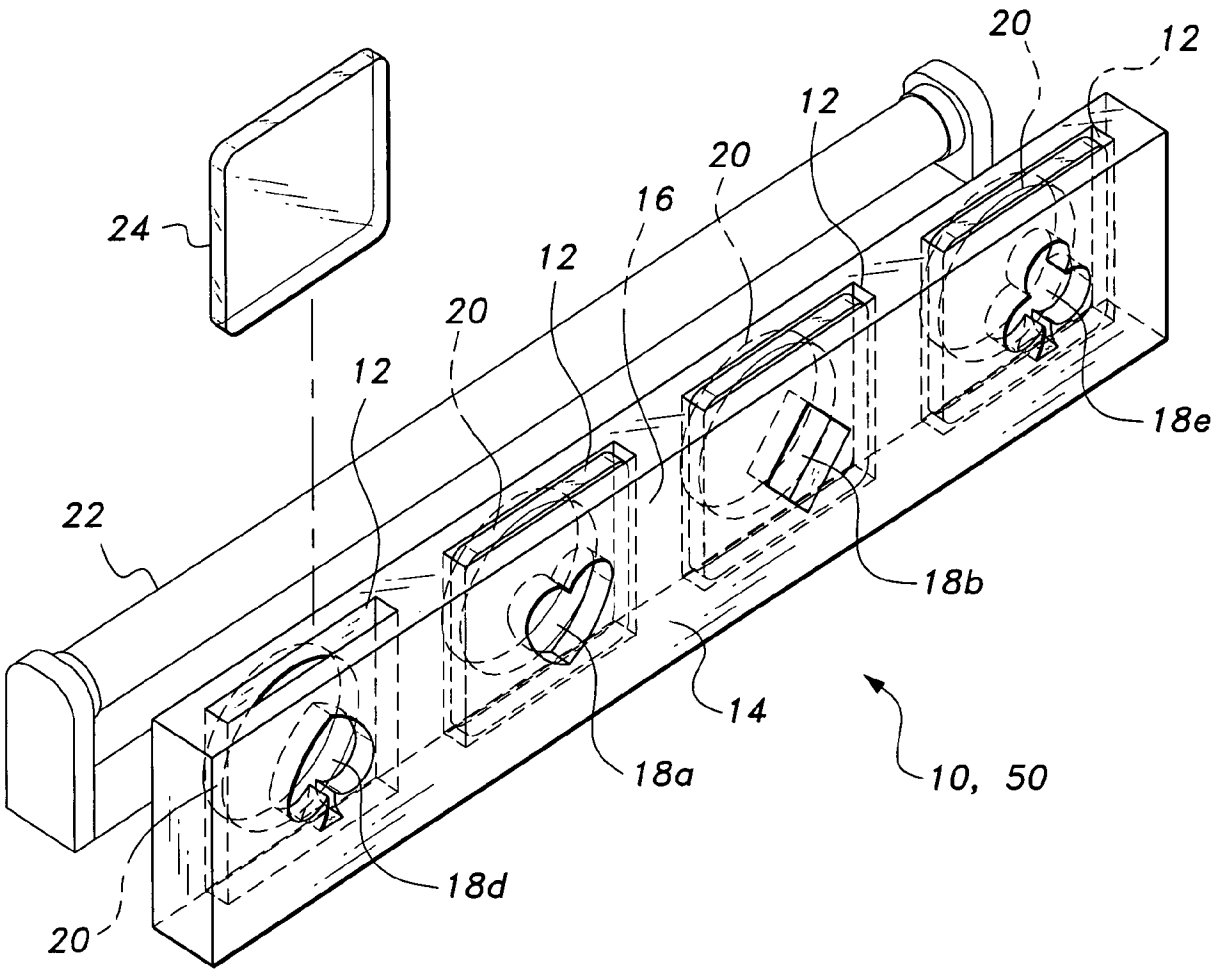
FIG. 2 is an exploded perspective view of a first embodiment of illuminated cabinet soffits and aprons according to the present invention, showing the insertion of translucent panes therein.

FIG. 1 of the drawings provides an illustration of a cabinet installation, including a series of illuminated soffit panels 10 and apron panels 50. FIG. 2 illustrates further details of the soffit and apron panels. Each of the panels or boards 10 and 50 is formed of a single, unitary length of material (e.g., wood board, metal, plastic, etc.) with a series of pockets 12 cut therein for holding corresponding translucent panes. Each of the pockets 12 may be formed as a saw kerf, or routed or otherwise cut from the material between the front and rear faces 14 and 16 of the soffit or apron panel 10 or 50. The pockets 12 are cut through the upper edges of the soffit and apron panels 10 and 50, but do not extend through the bottom edges of the panels. Each of the pockets 12 is discrete from its adjacent pocket to provide a plurality of separate and distinct pockets in each soffit and apron panel 10 and 50.

The front face 14 of each soffit and apron panel 10 and 50 includes at least one light passage 18 formed therethrough in the corresponding pocket 12, with the opposite rear face 16 having a corresponding light passage 20 formed therethrough. The light passages 18 and 20 are at least generally aligned with their corresponding pocket 12 to allow light to pass through the pocket 12 and passages 18, 20 from the back to the front of the board or panel 10 or 50. The rear light passages 20 may be any suitable or practicable shape, so long as they allow light to pass or diffuse through essentially the entire front light passages 18. The front light passages 18 may have any desired shape, e.g., regular or irregular geometric shapes, silhouettes or outlines of caricatures, objects or articles used in one's occupation or hobbies, etc. For example, the front light passages 18 of the soffit panels 10 of FIG. 1 is an alternating series of heart shapes 18*a* and diamond shapes 18*b*, while the front light passages 18*c* of the aprons 50 are relatively simple circular shapes. Such circular shapes are easily formed with a hole saw, while more complex shapes may be routed, laser cut, etc. using known technology.

FIG. 2 illustrates the backlighting of an exemplary soffit panel 10 or apron panel 50 using a conventional fluorescent tube 22 disposed behind the soffit or apron panel. Other forms of lighting may be used, e.g., incandescent, light emitting diodes (LEDs), etc. The panel 10, 50 of FIG. 2 differs further from the soffit 10 and apron 50 of FIG. 1 in that the panel includes four different cutouts or shapes for the front light passages, i.e., a spade-shaped passage 18*d*, the heart-shaped and diamond-shaped passages 18*a* and 18*b* also being used in the soffit panel 10 of FIG. 1, and a club-shaped passage 18*e*. Such a soffit or apron panel might be installed in a den or recreational room in a home, or perhaps a casino or other area where card games are played from time to time.

Each pocket 12 has a pane 24 capable of transmitting light therethrough removably installed or placed therein, as shown in FIG. 2. The light transmissible panes 24 may actually be completely clear or transparent, but are preferably tinted, frosted, or otherwise made to be translucent. The panes 24 may be provided in any color(s), e.g. a relatively dark color, such as a dark blue or a neutral gray tint for the spade- and club-shaped light passages 18*c* and 18*d*, and a red tint for the heart- and diamond-shaped light passages 18*a* and 18*b* of the panel 10, 50 of FIG. 2, to represent at least the approximate colors of those suits in a deck of cards. Other colors may be provided, e.g., green for leaf-shaped light passages, appropriate colors for passages having the shapes of specific species of flowers, etc.

Figure 3:
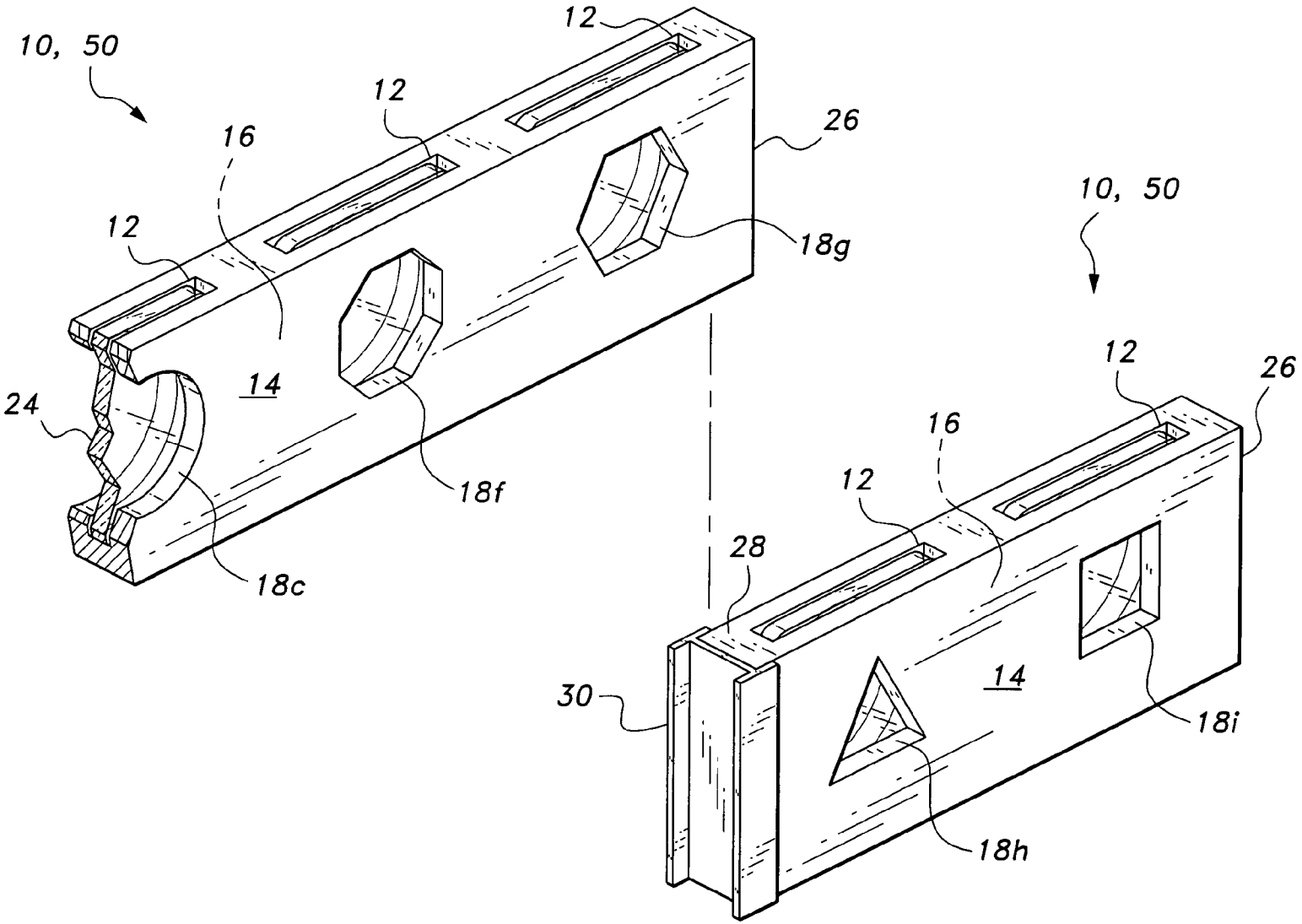
FIG. 3 is a fragmented, exploded perspective view of the end assembly of two panels of the illuminated cabinet soffits and aprons according to the present invention, showing their assembly.

The soffit and apron panels 10 and 50 are preferably provided as prefabricated modules, i.e., precut to predetermined lengths, with precut shapes for the front light passages 18. Customers may select the style desired in keeping with their desires for decorating the room or other area in which the panels 10, 50 are to be installed. As the panels 10, 50 are provided in predetermined lengths, e.g., four feet or so, a series of such panels must be placed end-to-end to span a longer distance. FIG. 3 provides an illustration of a portion of a first panel 10 or 50 having a circular front light passage 18*c*, octagonal and hexagonal front light passages 18*f* and 18*g*, and a first end 26. A separate but identical second panel 10, 50 includes triangular and a square front light passages 18*h* and 18*i*, respectively, and opposite first and second ends 26 and 28. An end having an I-beam shape joining bracket 30 having a central web essentially equal in width to the thickness of the two panels and two opposed flanges is placed upon the adjacent first and second ends 26, 28 of the two panels to secure them to one another in a continuous line. The panels 10, 50 may be slid from the bracket 30, e.g., to remove the panels 10, 50 for maintenance to any light fixture installed therebehind, for changing the color(s) of the pane(s) installed therein, etc.

Figure 4:
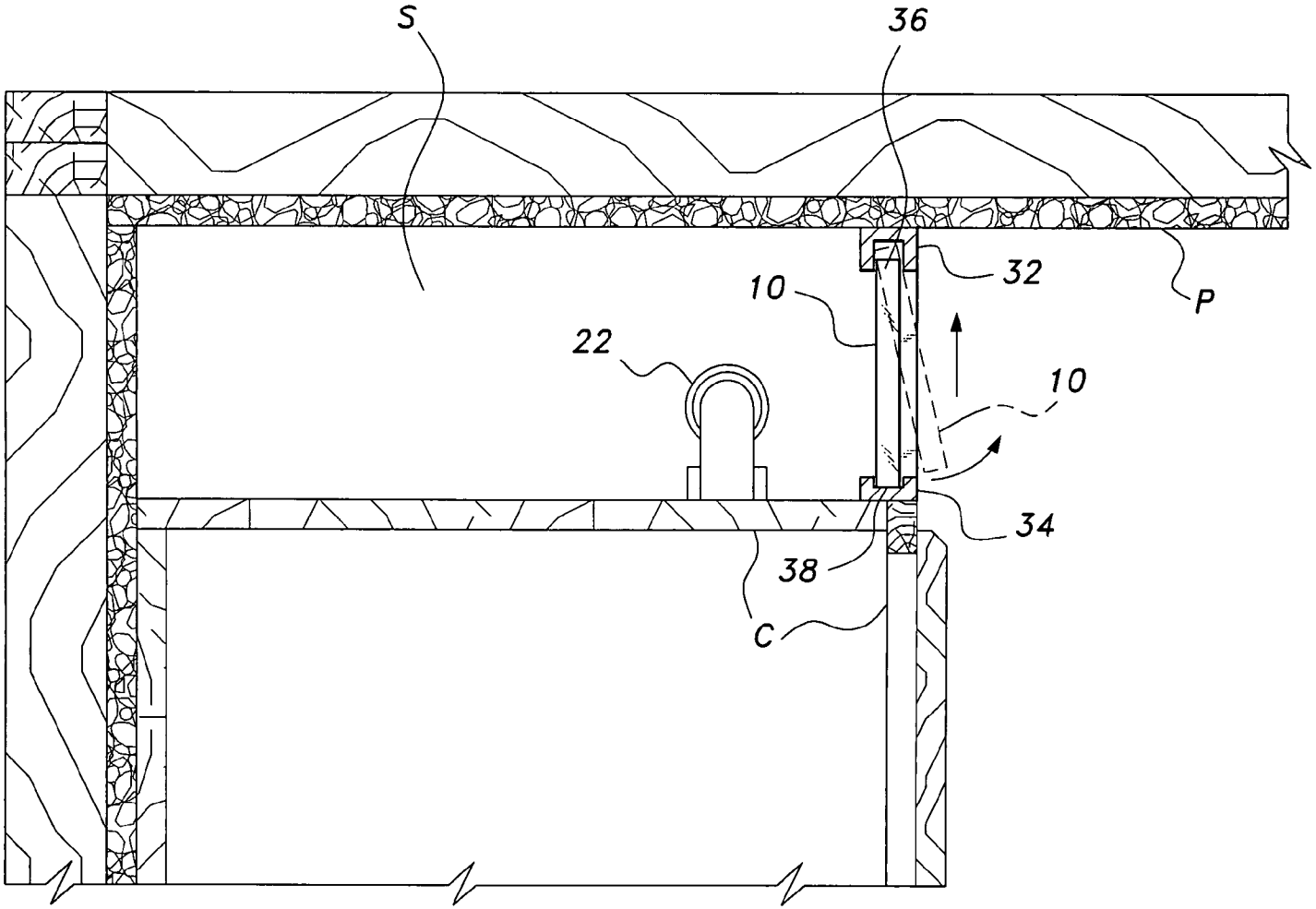
FIG. 4 is an end view in section of a soffit space above a cabinet, showing provision for removable illuminated soffit panels.

The illuminated cabinet soffits 10 and aprons 50 are preferably removably installed, rather than being permanently installed, in order to allow for maintenance to the light fixture and exchange of the various light panes, as noted above. FIG. 4 provides an illustration of such a removable soffit panel 10 installation. In FIG. 4, an inverted and relatively deep, generally U-shaped upper edge channel 32 is installed to the overhead ceiling panel P along the forward edge of the soffit space S above the forward edge of the cabinets C. An opposite, generally U-shaped lower edge channel 34 is secured along the upper and forward edge of the cabinets C, with the two open channels 32 and 34 facing one another.

The vertical span of the installed soffit panel 10 is slightly less than the distance between the bases of the two channels 32 and 34, thus allowing some vertical play when the soffit panel 10 is installed in the two channels 32 and 34. When the soffit panel 10 is lifted so that its upper edge 36 contacts the inner base or floor of the upper edge channel 32, the lower edge 38 of the soffit panel 10 is slightly above the upstanding edges or sides of the lower edge channel 34. This allows the soffit panel 10 to be swung outwardly, as shown in broken lines in FIG. 4, for removal from its installed position for access to the light fixture 22 therebehind, for exchanging one or more of the translucent panes installed within the soffit panel 10, or perhaps for exchanging the entire soffit panel 10 for one with a different appearance. The apron panels 50 may be removably installed below the forward edge of the cabinetry by a similar channel configuration, with the lower edge channel 34 being suspended from a series of vertical ties extending downwardly from the bottom of the cabinetry or the overlying upper edge channel 32.

Figure 5:
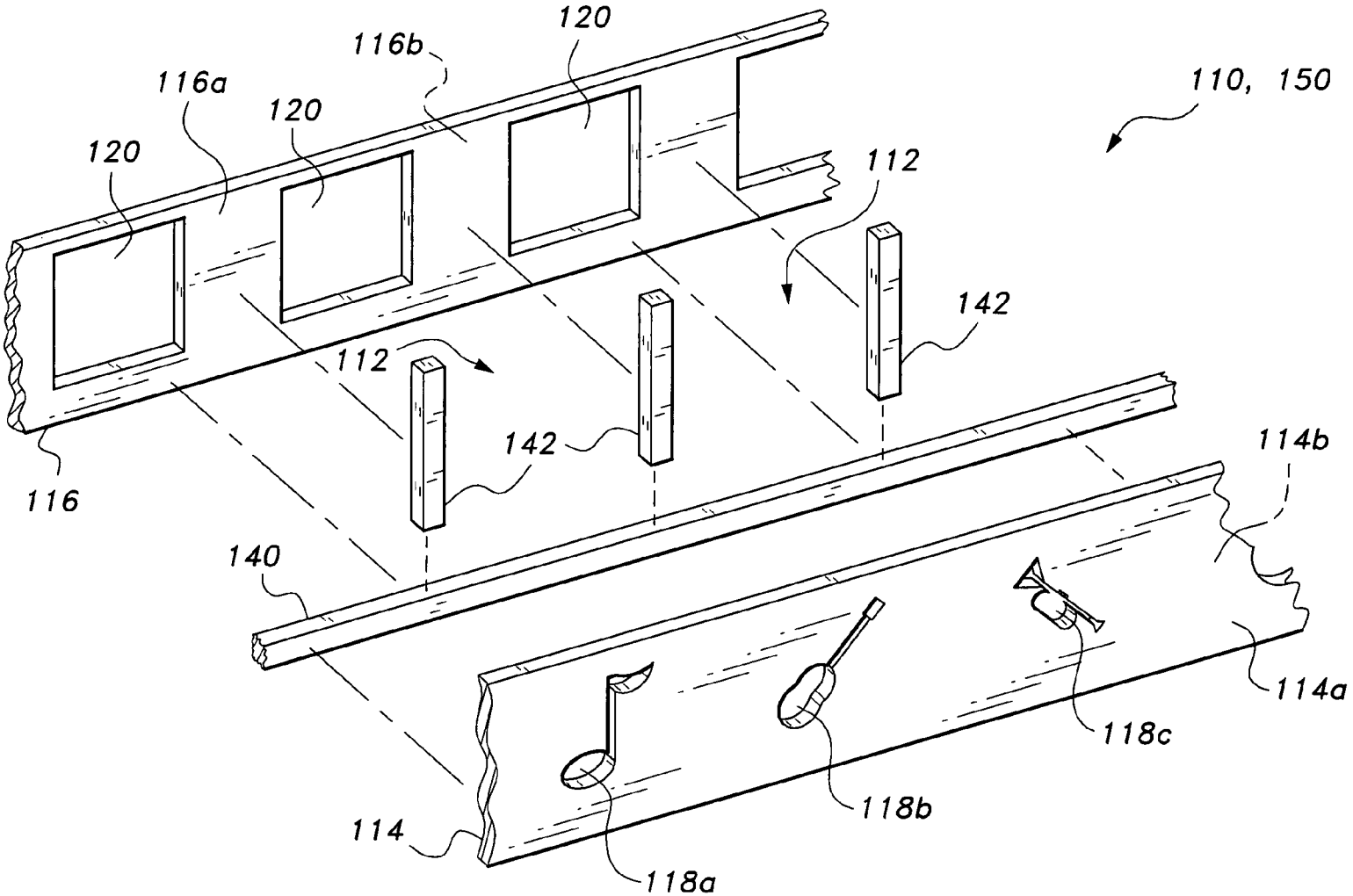
FIG. 5 is an exploded perspective view of an alternative embodiment of illuminated cabinet soffits or aprons according to the present invention.

The soffit and apron panels may be constructed of a plurality of pieces or components, rather than being formed from a single unitary sheet of wood or other material, as in the case of the soffit and apron panels 10 and 50 of FIGS. 1 through 4. FIG. 5 provides an exploded perspective view of such an alternative soffit and apron construction. The soffit 110 or apron 150 of FIG. 5 includes a front sheet 114 and a separate rear sheet 116 separated by further structure therebetween and described further below. The front sheet 114 has a front surface 114*a* and an opposite rear surface 114*b*, with a plurality of front sheet light passages 118*a*, 118*b*, 118*c*, etc., being formed therethrough. The exemplary front light passages 118*a* through 118*c* of the soffit 110 or apron 150 panel assembly of FIG. 5 are in the form of silhouettes of musical instruments. Again, the various front light passages (or light passages through the rear face or sheet, for that matter) may be in any desired form or shape. The rear sheet 116 serves as a pane-retaining member and includes a front surface 116*a* and opposite rear surface 116*b*, with a plurality of rear sheet light passages 120 being formed therethrough. The front light passages 118 and rear light passages 120 are at least generally aligned with one another when the soffit or apron panel 110, 150 of FIG. 5 is assembled.

A plurality of additional structural members are installed between the two sheets 114 and 116 to separate the two sheets and provide pockets 112 for the light panes to be installed therein. A single elongate lateral spacer 140 is secured along the lower edge of the rear surface 114*b* of the front sheet 114 and along the lower edge of the front surface 116*a* of the rear sheet or pane retaining member 116. A series of vertical spacers 142 are also secured to the rear surface 114*b* of the front sheet 114 and to the front surface 116*a* of the rear sheet 116 between the light passages 118 and 120. The lateral spacer 140, thus, defines the bottom of a plurality of pockets 112 for removably holding the light panes, with the vertical spacers 142 defining the lateral limits of the pockets 112. The front and back surfaces 114*b*, 116*a* of the front 1 14 and rear 116 sheets define the front and rear limits of the pockets 112. The upper edges of the pockets 112 remain open to permit the insertion and removal of light panes therein, e.g., light pane 24 of FIG. 2.

Figure 6:
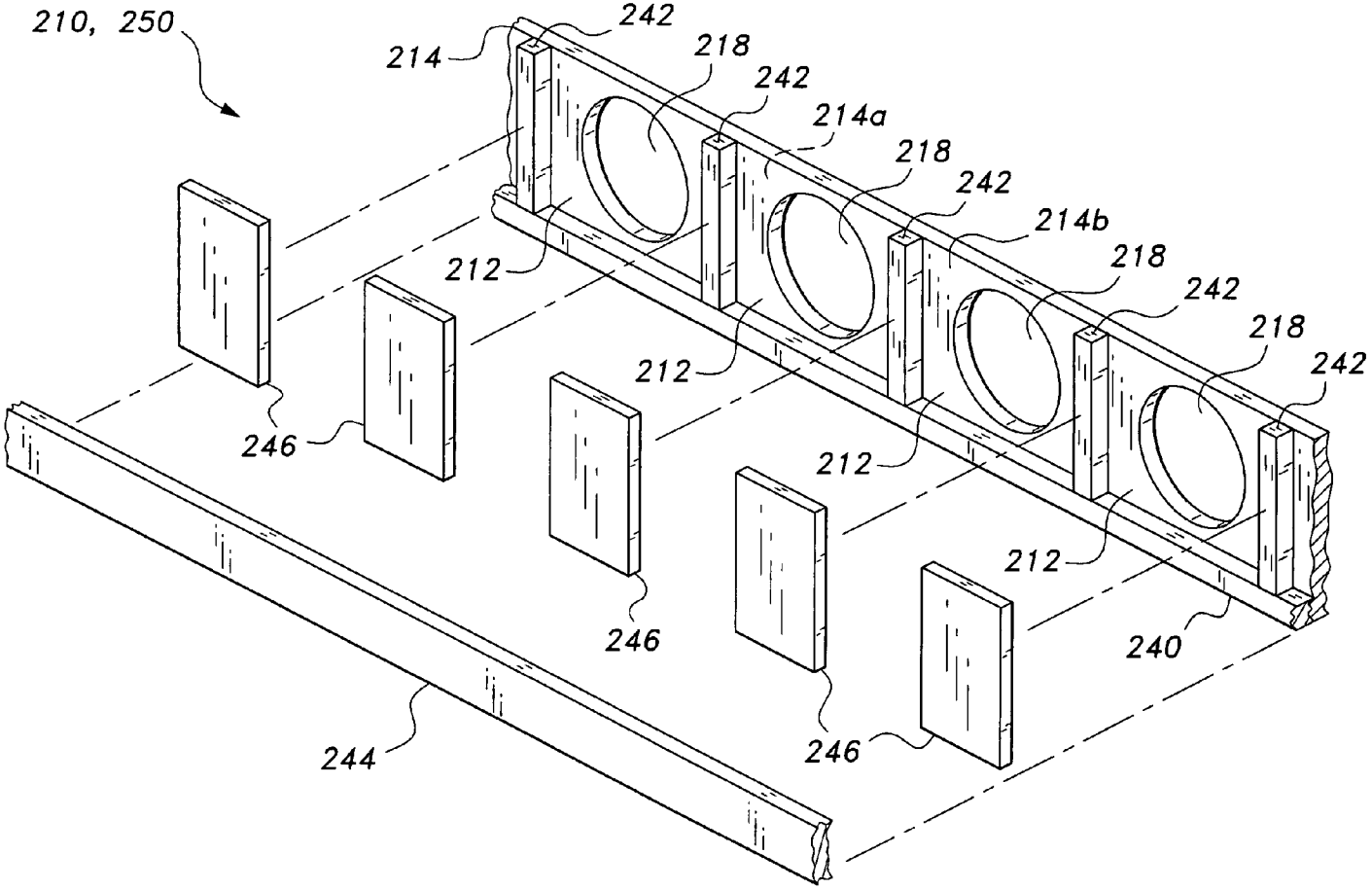
FIG. 6 is an exploded perspective view of another alternative embodiment of illuminated cabinet soffits and aprons according to the present invention.

FIG. 6 is an exploded rear perspective view of yet another embodiment of the illuminated cabinet soffits and aprons, comprising a soffit 210 or apron 250. The soffit or apron 210, 250 of FIG. 6 includes a front sheet 214 having a front surface 214*a* and opposite rear surface 214*b*, as in the case of the embodiment of FIG. 5. A series of front face light passages, e.g., circular light passages 218, or other shape(s) as desired, are provided through the front sheet 214. As in the case of the built-up soffit or apron panel 110, 150 of FIG. 5, the front sheet 214 and the rear retaining member are separated by a single elongate lateral spacer 240 secured along the lower edge of the rear surface 214*b* of the front sheet 214. A series of vertical spacers 242 are secured to the rear surface 214*b* of the front sheet 214 between each of the light passages 218. The front sheet 214 defines the front of each pocket 212, with the lateral spacer 240 and vertical spacers 242 defining the bottom limits and lateral limits of the pockets 212.

However, rather than having a pane-retaining member comprising a single, continuous rear sheet as in the embodiment of FIG. 5, the backs of the translucent pane pockets 212 are defined by a plurality of separate, relatively wide webs. In the example of FIG. 6, a single, relatively wide lower lateral web 244 is secured to the back of the lateral spacer 240 and the lower portions of the vertical spacers 242. A relatively wide vertical web 246 is secured to each of the vertical spacers 242. These lateral and vertical webs 244, 246 do not extend across the entire span of each of the pockets 212 in order to provide a rear light passage between each adjacent vertical web 246, but they do extend sufficiently far to prevent the light panes, e.g., pane 24 of FIG. 2, from falling laterally away from the front sheet 214. It will be seen that the single lateral web 244 may be eliminated if so desired, with the backs of the pockets 212 being defined or limited by the lateral extent of each of the wide vertical webs 246 extending beyond their respective vertical spacers 242.

In conclusion, the illuminated cabinet soffits and aprons enable persons to quickly and easily change the appearance of a room or other area incorporating such panels. Rather than permanently securing the light panes to the rear surfaces of the panels, the user of such soffit and apron panels may merely remove the panel from its installation and remove and replace the light panes from the pockets within the panels, or exchange the entire soffit or apron panel for another configuration or style, if so desired. The modular nature of the soffit and apron panels facilitates installation and interchange by the homeowner or other person making use of such panels without requiring extensive remodeling or carpentry work to do so. The resulting savings in time and expense in comparison to changes to conventional light panels will prove to be most valuable to the owner or user.

It is to be understood that the present invention is not limited to the embodiments described above, but encompasses any and all embodiments within the scope of the following claims.

I claim:

1. An illuminated cabinet soffit and apron panel, comprising:

an elongate front face having at least one light passage disposed therein;

an elongate rear face opposite the front face, the rear face having at least one light passage disposed therein substantially aligned with the at least one light passage of the front face, the front face and the rear face comprise opposite sides of a single unitary board, wherein the unitary board includes an end joining bracket, the bracket adapted to join the single unitary board to another unitary board in end to end arrangement, the front face and rear face defining at least one pocket therebetween, the pocket being aligned with the light passages of the front face and rear face; and a pane capable of transmitting light removably disposed within the pocket.

2. The illuminated cabinet soffit and apron panel according to claim 1, wherein said board has a lower edge and an upper edge, the panel further comprising:

a U-shaped lower edge channel, the lower edge of the board resting removably within the lower edge channel; and a U-shaped, inverted upper edge channel, the upper edge of the board contained loosely and removably within the upper edge channel.

3. The illuminated cabinet soffit and apron panel according to claim 1, further including at least one light source disposed behind the rear face.

4. An illuminated cabinet soffit and apron panel, comprising a unitary, monolithic board having:

an elongate front face having at least one light passage disposed therein;

an elongate rear face opposite the front face, the rear face having at least one light passage disposed therein substantially aligned with the at least one light passage of the front face, the front face and rear face defining at least one pocket therebetween, the pocket being aligned with the light passages of the front face and rear face;

a pane capable of transmitting light therethrough removably disposed within the pocket; and further including at least one light source disposed behind the rear face.

5. The illuminated cabinet soffit and apron panel according to claim 4, further comprising a first said board, a second said board, and an end joining bracket, the bracket joining said first board and said second board end to end.

6. The illuminated cabinet soffit and apron panel according to claim 4, wherein said board has a lower edge and an upper edge, the panel further comprising:

a U-shaped lower edge channel, the lower edge of said board resting removably within the lower edge channel; and a U-shaped, inverted upper edge channel, the upper edge of said board contained loosely and removably within the upper edge channel.

7. An illuminated cabinet soffit and apron panel, comprising:

a front sheet having a front surface and a rear surface opposite the front surface, the rear surface defining the front of at least one pocket;

a plurality of spacers installed upon the rear surface of the front sheet, the spacers defining the lower and lateral edges of the at least one pocket; and at least one pane-retaining member disposed across the plurality of spacers opposite the rear surface of the front sheet, the at least one pane-retaining member defining a back of the at least one pocket, wherein the at least one pane-retaining member comprises a plurality of wide webs corresponding to the plurality of spacers and secured thereto.

8. The illuminated cabinet soffit and apron panel according to claim 7, wherein the at least one pane-retaining member comprises a single rear sheet secured across the plurality of spacers.

9. The illuminated cabinet soffit and apron panel according to claim 7, further including at least one light source disposed behind the front sheet.

* * * * *